US005624118A

United States Patent [19]

Gottesman

[11] Patent Number: 5,624,118

[45] Date of Patent: Apr. 29, 1997

[54] PUZZLE WORK STATION AND STORAGE CASE INCORPORATING SPECIAL ADJUSTABLE FRAME

[76] Inventor: Elaine Gottesman, 453 Boca CiegaPtS, St. Petersburg, Fla. 33708

[21] Appl. No.: 706,782

[22] Filed: Sep. 3, 1996

[51] Int. Cl.[6] ..... A63F 9/10

[52] U.S. Cl. ..... 273/157 R; 40/739

[58] Field of Search ..... 273/157 R, 309, 273/148 R; 269/329; 40/700, 739

[56] References Cited

U.S. PATENT DOCUMENTS

| | | | |
|---|---|---|---|
| 2,003,072 | 5/1935 | Eynon | 273/157 R |
| 2,003,845 | 6/1935 | Whitcomb | 273/157 R |
| 2,506,189 | 5/1950 | Attridge | 273/157 R |
| 3,606,338 | 9/1971 | Cannata | 273/157 R |
| 4,053,159 | 10/1977 | Kulak | 273/157 R |
| 4,257,606 | 3/1981 | Launzel | 273/157 R |
| 4,865,325 | 9/1989 | Stolz | 273/157 R |
| 4,890,839 | 1/1990 | Ayotte | 273/157 R |
| 5,405,146 | 4/1995 | Washinton | 273/157 R |

FOREIGN PATENT DOCUMENTS

| | | | |
|---|---|---|---|
| 3711694 | 10/1988 | Germany | 273/157 R |

*Primary Examiner*—Raleigh W. Chiu

*Attorney, Agent, or Firm*—Philip Young, Esq.

[57] ABSTRACT

A combination puzzle work station, puzzle carrying case and adjustable puzzle picture frame kit includes selected sizes of interlocking frame sections providing; first, a bordered puzzle workstation and, then, a puzzle picture frame. A baseboard is set into the constructed border to provide the work station for assembly of a puzzle. One or more foam cover boards, used as storage areas for puzzle pieces, are placed on top of the puzzle "in progress" sandwiched by a second baseboard to contain the puzzle during travel. Dividers are provided on the foam boards to retain loose puzzle pieces securely while the puzzle is in progress, or during travel. A fastener clip is mounted in holes formed in the back of each frame section for retaining the baseboards and foamboards within the frame, both during transport of the puzzle carry case and for the mounting of the completed framed puzzle on a wall. A handle/hanger cord is provided with a pin retainer at each end for locking the cord onto the frame by means of special holes extending through frame sections.

13 Claims, 4 Drawing Sheets

PUZZLE WORK STATION AND STORAGE CASE INCORPORATING SPECIAL ADJUSTABLE FRAME

BACKGROUND OF THE INVENTION

1. Field of the Invention

The present invention relates to a work station for the assembly of a jig saw puzzle and, more particularly, to a combination adjustable puzzle picture frame kit, puzzle work station and finished puzzle picture frame.

2. Background Art

There is presently known jig saw puzzle work boards on which puzzles can be assembled and stored, in the partially assembled or finished condition. Such puzzle work boards are disclosed, for example, in U.S. Pat. Nos. 4,479,651 to Robert LaFleur, 4,865,325 to Larry W. Stolz and 4,436,307 to T. Francis Caldwell. Some puzzle work boards, such as the device described by Caldwell in the above noted U.S. Pat. No. 4,436,307, provide one or more trays adapted for holding puzzle pieces intact while the work boards are assembled into a carrying case for transporting the puzzle pieces. It would be desirable and advantageous if the puzzle board and work station were adapted to accommodate different size puzzles within a puzzle work station board. Also, in the known puzzle work stations, generally, the finished puzzle is removed from the work station and thereafter framed for display on a wall. It would also be desirable to provide a puzzle work station which is readily adaptable for framing the puzzle completed thereon.

SUMMARY OF THE INVENTION

These, and other objects, are achieved by the present invention which provides a combination puzzle work station, puzzle carrying case and adjustable puzzle picture frame kit includes selected sizes of interlocking frame sections providing; first, a bordered puzzle workstation and, then, a puzzle picture frame. A baseboard is set into the constructed border to provide the work station for assembly of a puzzle. One or more foam cover boards, used as storage areas for puzzle pieces, are placed on top of the puzzle "in progress" sandwiched by a second baseboard to contain the puzzle during travel. Dividers are provided on the foam boards to retain loose puzzle pieces securely while the puzzle is in progress, or during travel. A fastener clip is mounted in holes formed in the back of each frame section for retaining the baseboard and foamboards within the frame, both during transport of the puzzle carry case and for the mounting of the completed framed puzzle on a wall. A handle/hanger cord is provided with a pin retainer at each end for locking the cord onto the frame by means of special holes extending through frame sections.

DESCRIPTION OF THE PREFERRED EMBODIMENTS

Figure 1:
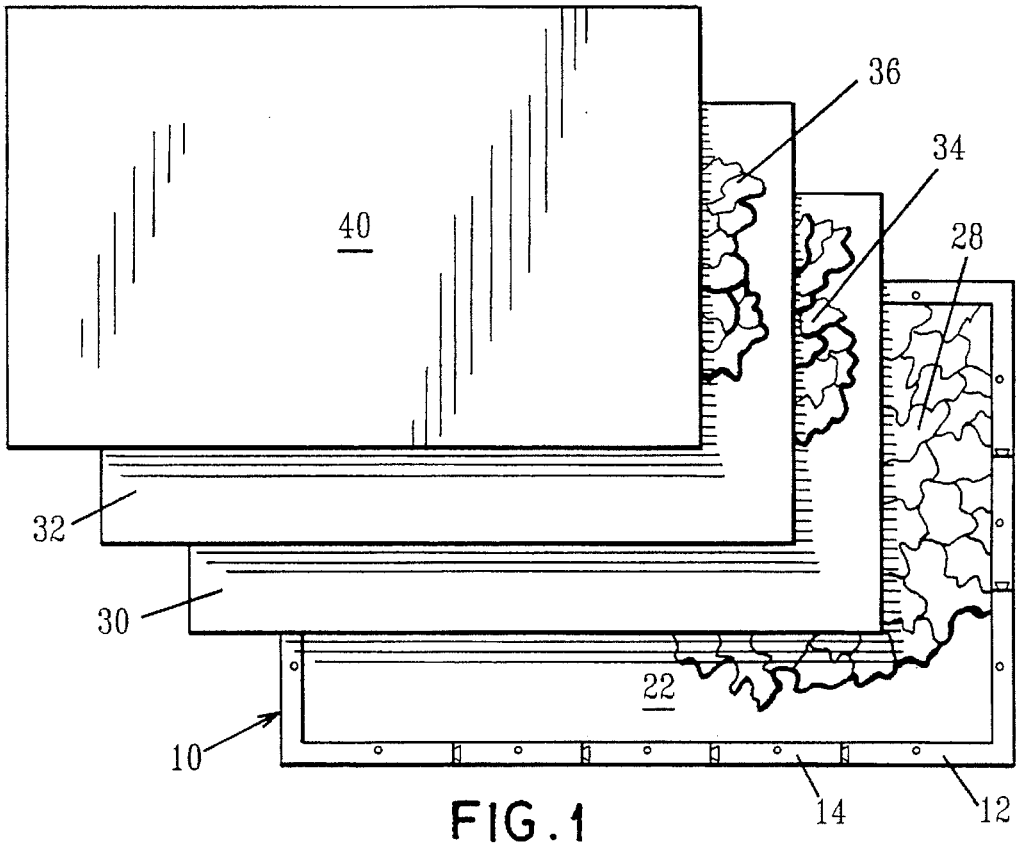
FIG. 1 is an exploded view of the combination adjustable picture frame, puzzle work station and puzzle carrying case; illustrative of the present invention.
Figure 8:
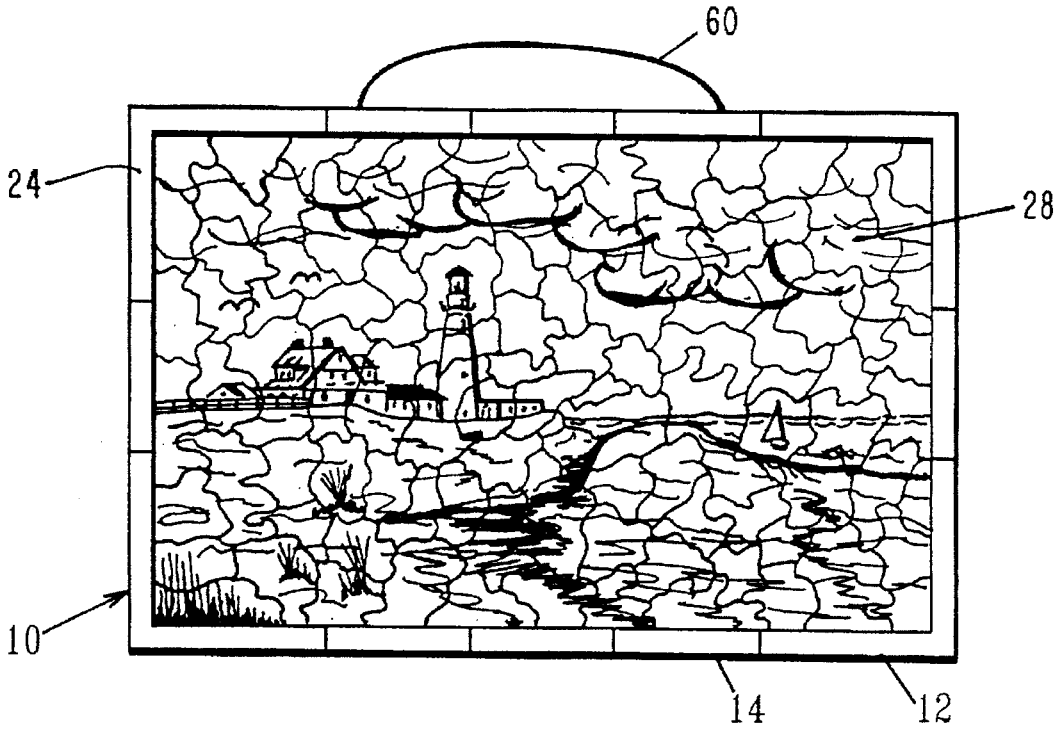
FIG. 8 is a front view of the completed puzzle set within an adjustable frame.

Referring to FIG. 1 showing an exploded assembly view, the combination puzzle work station and adjustable puzzle picture frame includes a puzzle frame 10 made of selected size corner pieces 12 and straight side pieces 14 which are joined, as shown in FIGS. 2,3,4 and 5, by interlocking dove tails 16 and channels 18 provided at opposite ends of the frame pieces 12 and 14 to form the desired size frame border and puzzle work station. Each corner piece 12 and straight side piece 14 of the frame 10 includes a shoulder portion 20 providing a ledge for supporting a rectangular baseboard 22 which fits around all four sides thereof and, also, such shoulder portion 20 is employed as the frame molding for holding the finished puzzle, which is reversed with its baseboard on which it sits, to face the front surface 24 of the frame 10, as shown in FIG. 8. The rear surface 26 of the frame 10 is indicated by numeral 26 in FIGS. 2–6.

Figure 2:
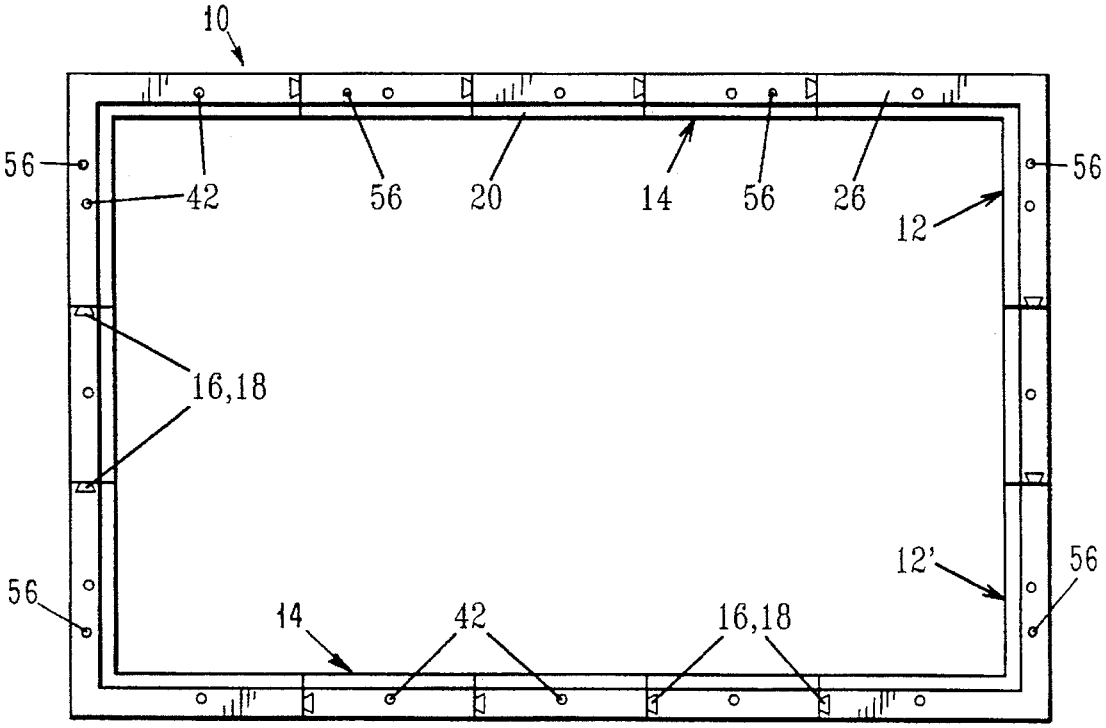
FIG. 2 is a rear view of the adjustable picture frame in its assembled condition.
Figure 3:
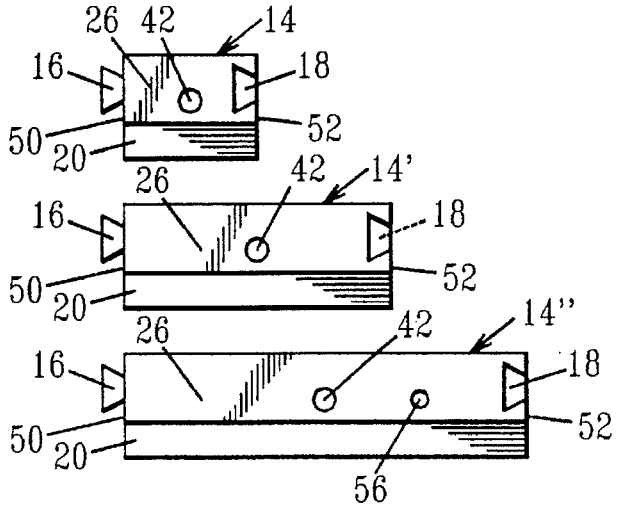
FIG. 3 is a rear view of three straight frame sections having different lengths for selection when constructing a desired size picture and puzzle frame and work station.
Figure 4:
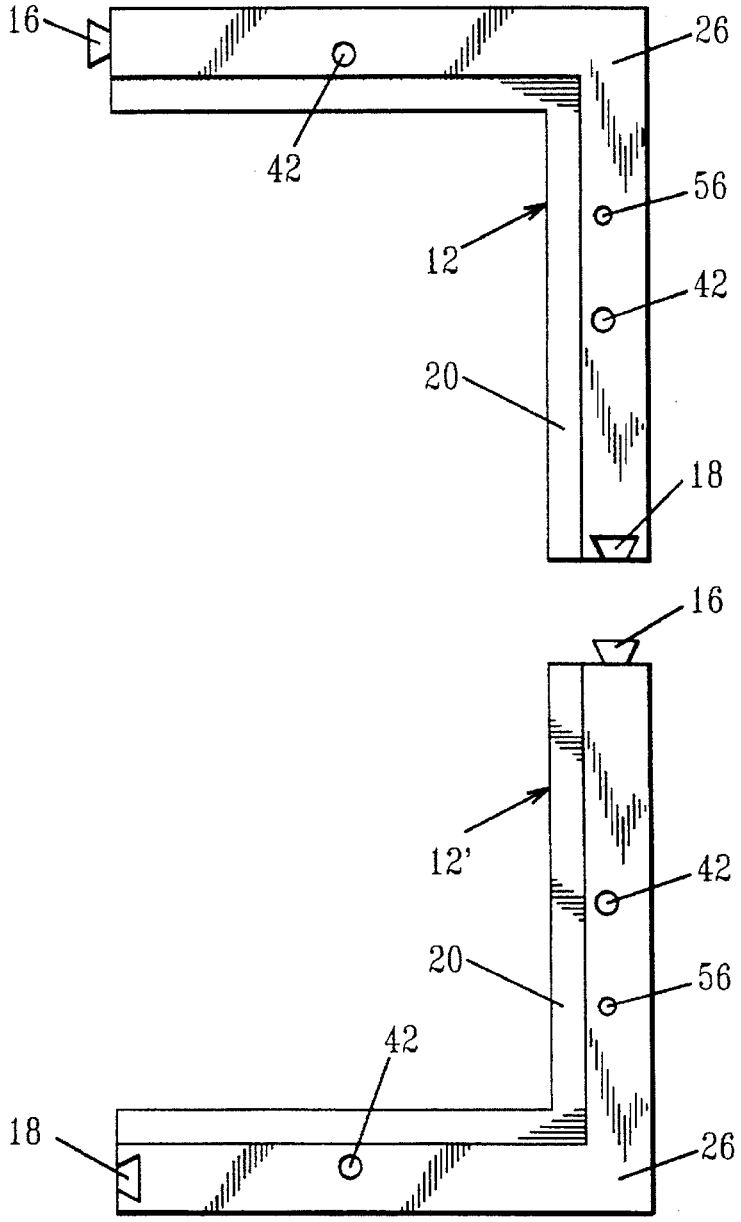
FIG. 4 is a rear view of two corner frame sections having different lengths for selection when constructing a desired size picture and puzzle frame and work station.

The puzzle work station is formed by placing the assembled frame 10 with its rear surface 26 facing upwards, as shown in FIGS. 1 and 2, and inserting the baseboard 22 within the frame 10 resting on the shoulder portion 20. A puzzle 28 can now be assembled on the combined frame 10 and baseboard 22. A second and third board, or flat foam cushions 30 and 32 are placed on top of the puzzle 28 in progress to contain the pieces 34 and 36 of puzzle 28. Cushions 30 and 32, along with puzzle pieces 34 and 36, respectfully, being of flexible material, are sandwiched between the baseboard 22 and a cover board 40 when the puzzle is not in progress, as well as during carrying and in the completed framed puzzle. One or both cushions 30 and 32 may be made of a thin sheet, such as one eighth inch thick, of polyurethane foam or other form of cushioned material which flexes for assisting in holding the puzzle pieces in place, while not adding substantially to the overall thickness of the cushions 30 and 32 between the baseboard 22 and coverboard 40. The outside coverboard 40 fits adjacent to cushion 32 and serves as the outside board for the travelling case, or the framed puzzle.

Figure 7:
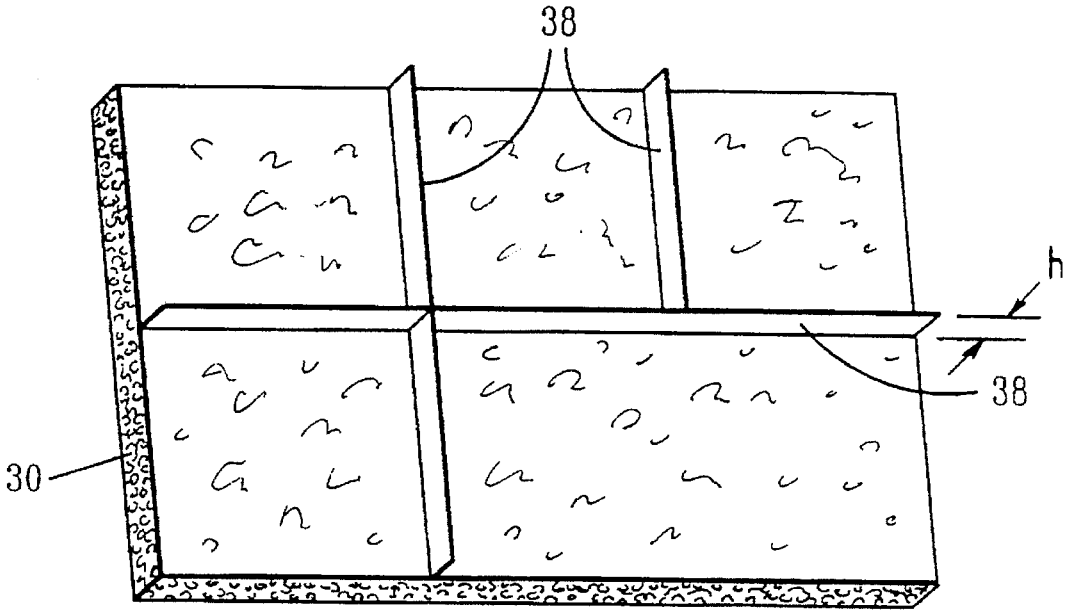
FIG. 7 shows a puzzle board with a divider for puzzle pieces.

Cushion 30 can be provided with sectional dividers 38, shown in FIG. 7, which are placed on top of the cushion 30 to form sections to receive and organize loose puzzle pieces or attached puzzle sections and securely contain them in the carry case during travel. Board 32 can similarly be provided with the sectional dividers 38. The height h of the divider 38 may, for example, be one eighth inch or less, so that the divider can be pressed against the cushions 30 and 32 and be embedded therein without adding to the overall thickness of the combiner boards and cushions. Dividers 38 are made of plastic or wood.

As described above, the puzzle work border serves also as the finished picture frame. The size of the frame can be constructed to the specific desired size by selecting from many different size straight pieces, such as the three frame pieces 14, 14' and 14", illustrated in FIG. 3, and the one standard size corner pieces 12 and 12' illustrated in FIG. 4

The straight frame pieces can, for example, be available in preselected sizes, such as one, two three, four and five inches long, while the four corner frame pieces 26 can come in one standard length, such as four inch long legs. Each frame piece 14 and 26 is provided with interlocking dove tails 16 and recess channels 18, shown in greater detail in FIG. 5. Dove tail 16 protrudes out of the sidewall 50 of the frame section, while the recess channel 18 is provided within the sidewall 52 of the frame section and receives the dove tail 16 in a tight fitting locking manner.

Figure 5:
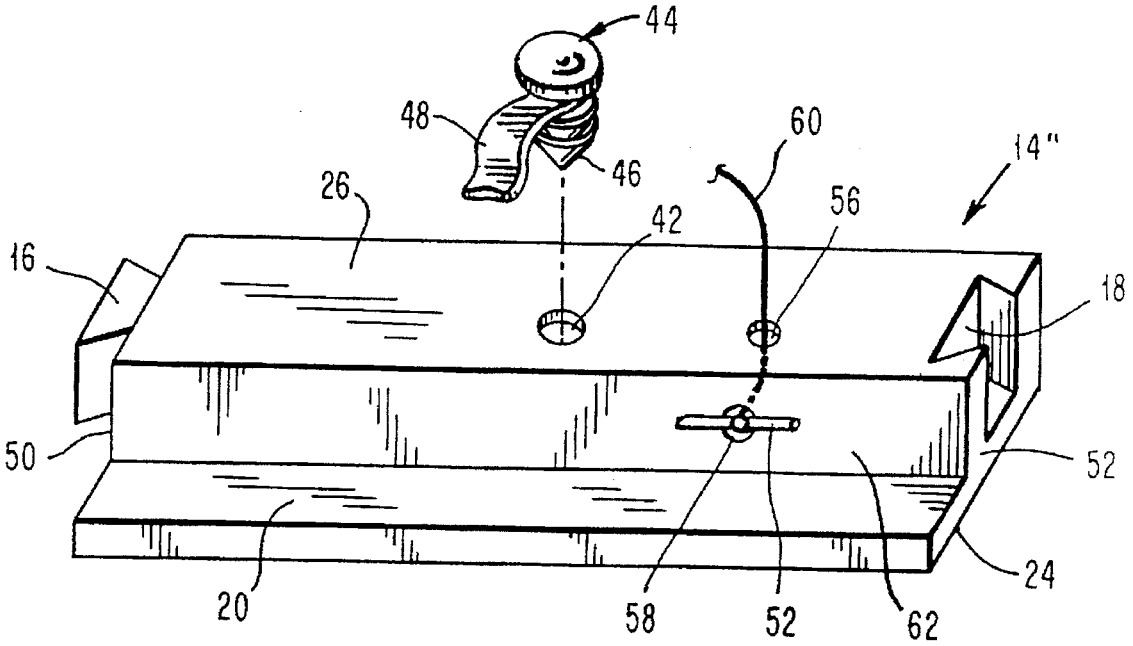
FIG. 5 is a perspective view of one frame straight section showing the fastener and clip device and the hanger cord and mounting on such frame section.

As shown in FIG. 5, a fastener 44 for retaining the outside cover board 40 within the frame is mounted in each of a plurality of holes 42 provided in the frame pieces 12 and 14. Fastener 44 includes a conventional type of bayonette post 46 and a clip 48 mounted at the top of the bayonette post 46 such that when the post 46 is inserted in the hole 42, its bayonetres will lock into the side walls of the hole, thereby locking the fastener 44 in place in the hole 42. The clip can be rotated into the locking position to hold the outside cover board 40 on the frame, or rotated to permit removal of the boards contained therein.

Figure 6:
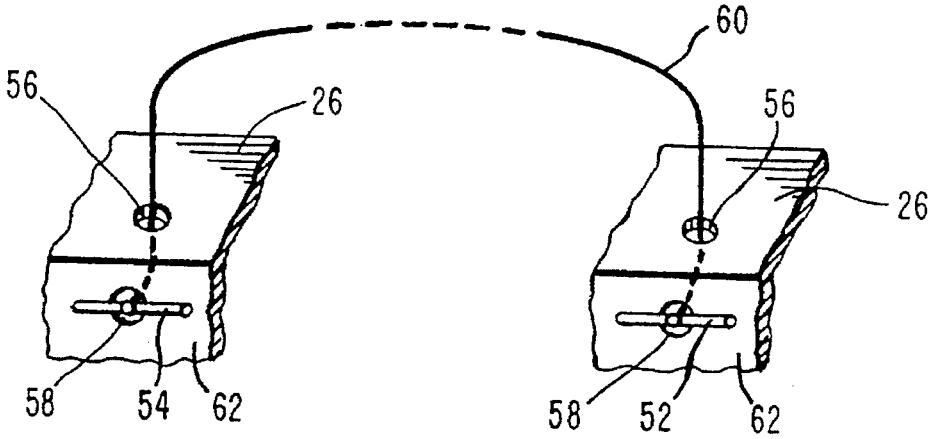
FIG. 6 is a simplified view of a hanger cord and its mounting means on a frame section.

A hanger cord 60 is provided for hanging the completed puzzle in the picture frame, or as a handle for a carrying case and includes a metal barb pin 52 attached at each end of the cord 60 and designed to be easily installed on the frame section, as shown on the section 14" shown in FIGS. 5 and 6. Here, a hole 56 is provided through the rear wall surface 26 of frame section 14" and extends through to a hole 58 in the side wall 62. The hanger cord 60 is inserted through the hole 56 and. 58 by passing the barb pin 52 through the hole, after which the pin 52 will extend across the hole 58 and lock the cord 60 in position. Alternately, the cord 60 can be attached or knotted onto the pin 52 after cord 60 is passed through the holes 56 and 58. In this fashion, the framed puzzle can be hung without attaching screws or nails to the frame.

The technique for using the jigsaw puzzle kit containing the work station, carrying case and adaptable picture frame according to the present invention includes initially assembling the work station border by interlocking the four corner frame sections 12 and 12' and the selected straight sections 14, 14' and 14" to form the subject puzzle size dimensions. Fasteners 44 and retainer clips 48 are mounted in holes 42 in the back of the frame sections 12 and 14. The hanger cord 60 is simply inserted into the holes 56 and 58 in the back of the frame sections where the location is suitable for wall mounting the completed puzzle and frame. Cord 60 also serves as the handle for the puzzle carry case. The baseboard 22, cut to the selected frame size, is placed on the shoulder 20 of the assembled work station border. The puzzle is constructed within the work station area with the additional use of cushioned boards 30 and 32 which provide storage areas while the puzzle is in progress. For use as a carrying case, the cushioned boards 30 and 32 are placed directly on top of the puzzle in progress and a second baseboard, or coverboard 40, is placed over the cushioned boards 30 and 32. The fastener clips 48 are then turned inward to hold the sandwiched boards together. The hanger cord 60 is used as a handle for the carrying case.

For the final transition of a work station to a framed puzzle picture, a water base, a water base glue, not shown, is applied to one side of a second baseboard, similar to the baseboard 22. The completed puzzle 28 is transferred to the glued baseboard and allowed to dry. The baseboard 22 with the glued puzzle thereon is then flipped over and properly positioned onto the shoulder 20 of the work station border. Storage cushions or coverboards 30,32 are placed on top of the baseboard 22, on the side opposite to the glued puzzle side. A coverboard 40 is placed on top of the cushioned boards 30,32 and bhe fastener clips 48 are turned to securely hold down the sandwiched layers of boards. The completed puzzle picture is now ready for hanging.

While the invention has been described above with respect to its preferred embodiments, it should be understood that other forms and embodiments may be made without departing from the spirit and scope of the present invention.

What is claimed is:

1. A combination puzzle work station, puzzle carrying case and adjustable puzzle picture frame kit, comprising:

(a) a work station border constituted by selectable sizes of interlocking right angle frame corner sections and straight frame sections providing, first, a bordered puzzle workstation and, then second, a puzzle picture frame for the completed puzzle, each said frame section including a shoulder portion extending out from an interior wall of said frame section, and each said frame section having an end wall adapted to abut with the end wall of an adjacent frame section and locking means in said end walls for interlocking said frame sections together;

(b) a baseboard made of a flat board sized to fit within said work station border with the baseboard edges lying against said shoulder portion such that said baseboard and said work station border provide the work station for assembly of a puzzle thereon;

(c) at least one coverboard, for placing on top of the puzzle in progress, to contain the puzzle during travel;

(d) fastener clip means adapted for mounting in the back of each frame section and for retaining said coverboard and baseboard within said work station border, both as a puzzle carry case during transport of the puzzle, and for the mounting of the completed framed puzzle; and (e) a handle and puzzle picture hanger cord adapted for securing to selected ones of said frame sections;

whereby the selected sizes of interlocking frame sections provide both a bordered puzzle workstation and, also, an adjustable puzzle picture frame.

2. A puzzle work station and picture frame kit as recited in claim 1, wherein said locking means on each frame section comprises a recess channel in one end wall of each frame section and an interlocking dove tail in the other end wall of each channel arranged such that frame sections are locked together by attaching a dove tail of one frame section to a recess channel in the adjacent frame section.

3. A puzzle work station and picture frame kit as recited in claim 1, wherein said fastener clip means adapted for mounting in the back of each frame section includes a hole formed in a back wall of each frame section, and a holding clip mounted on a post which is securely mounted in said hole, whereby said clip can be rotated for retaining said coverboard and said baseboard within said work station border.

4. A puzzle work station and picture frame kit as recited in claim 1, further comprising a passage extending from a back wall of a frame section and continuing out through a side wall thereby forming a passage through said frame section, and a retainer bar adapted for attachment to an end of said handle and puzzle picture hanger cord whereby said cord extends through said passage and is attached at each cord end to a frame section by said retainer bar extending across said passage.

5. A puzzle work station and picture frame kit as recited in claim 1, further comprising one or more cushion boards, made of a flexible cushion material, for placing on top of a puzzle in progress for sandwiching the puzzle pieces between a coverboard and a cushion board.

6. A puzzle work station and picture frame kit as recited in claim 5, wherein said cushion boards are made of polyurethane foam.

7. A puzzle work station and picture frame kit as recited in claim 5, further comprising a sectional divider made of a rigid material forming wall sections having a height h which is about the same as the thickness of said cushion boards, said sectional divider being placed on top of said cushion board to retain loose puzzle pieces securely within said wall sections while the puzzle is in progress, or during travel.

8. A puzzle work station and picture frame kit as recited in claim 1, wherein the completed puzzle is mounted on said baseboard, said baseboard is inverted and fits on said shoulder portion of said frame sections, said coverboard is retained in place by said fastener clips, and said hanger cord is attached to said frame sections at both cord ends, whereby said puzzle work station becomes a framed puzzle picture for hanging on a wall.

9. A method for providing a combination puzzle work station, puzzle carrying case and selectible size puzzle picture frame, comprising:

selecting the desired size of interlocking right angle frame corner sections and straight frame sections and interlocking said frame sections to provide, first, a work station border and, then second, a puzzle picture frame for a puzzle that is assembled within said work station border, each said frame section including a shoulder portion extending out from an interior wall of said frame section, and each said frame section having an end wall adapted to abut with the end wall of an adjacent frame section, locking means in said end walls for interlocking said frame sections together, a front wall and a back wall;

inserting a flat baseboard with its baseboard edges lying against said shoulder portions of said frame sections such that said baseboard and said work station border provide the work station for assembly of a puzzle thereon;

placing at least one coverboard on top of the puzzle in progress to contain the puzzle during travel;

mounting fastener clip means in the back wall of frame sections for retaining said coverboard and baseboard within said work station border, both as a puzzle carry case during transport of the puzzle, and for mounting of the completed framed puzzle;

mounting the completed puzzle on a baseboard and inserting the completed puzzle and baseboard against the shoulder portions of said frame sections with said completed puzzle on said front wall side of said frame sections; and adjusting said fastener clip means to secure said baseboard on said frame sections, whereby a puzzle picture frame is ready for mounting on a wall.

10. A method as recited in claim 9, further comprising securing a handle and puzzle picture hanger cord to selected ones of said frame sections whereby the selected sizes of interlocking frame sections provide both a bordered puzzle workstation and, also, an adjustable puzzle picture frame.

11. A method as recited in claim 9, further comprising inserting a further coverboard, made of a flexible cushion material, on top of a puzzle in progress, to contain the puzzle during travel.

12. A method as recited in claim 11, further comprising placing a sectional divider, made of a rigid material forming wall sections, on top of said further coverboard to retain loose puzzle pieces securely within said wall sections while the puzzle is in progress, or during travel.

13. A method as recited in claim 9, wherein the completed puzzle is mounted on said baseboard, said baseboard is inverted and fits on said shoulder portion of said frame sections, said coverboard is retained in place by said fastener clips, and a hanger cord is attached to said frame sections at both hanger cord ends, whereby said puzzle work station becomes a framed puzzle picture for hanging on a wall.

* * * * *